United States Patent [19]

Caprio

[11] Patent Number: 5,041,012

[45] Date of Patent: Aug. 20, 1991

[54] INSULATION PIERCING ELECTRICAL CLAMP CONNECTOR

[75] Inventor: Joseph Caprio, Madison, Conn.

[73] Assignee: Bardes Corporation, Ilsco Division, Cincinnati, Ohio

[21] Appl. No.: 371,925

[22] Filed: Jun. 27, 1989

[51] Int. Cl.[5] ..... H01R 4/24

[52] U.S. Cl. ..... 439/413; 439/409

[58] Field of Search ..... 439/409–414, 439/417–419, 791–794, 781, 782

[56] References Cited

U.S. PATENT DOCUMENTS

| | | | |
|---|---|---|---|
| 2,159,064 | 5/1939 | Walter | 439/412 |
| 4,427,253 | 1/1984 | Smith et al. | 339/98 |
| 4,652,071 | 3/1987 | De Bortoli et al. | 439/412 |
| 4,684,196 | 8/1987 | Smith et al. | 439/411 |

FOREIGN PATENT DOCUMENTS

| | | | |
|---|---|---|---|
| 2903960 | 8/1980 | Fed. Rep. of Germany . | |
| 3715529 | 10/1988 | Fed. Rep. of Germany | 439/411 |

*Primary Examiner*—David L. Pirlot

*Attorney, Agent, or Firm*—Wood, Herron & Evans

[57] ABSTRACT

An electrical clamp connector having two body halves molded of insulative material and clampable about at least two insulated conductors electrically and mechanically join them together, is provided with a chimney projecting from the clamping side of the base half of the body. A bolt hole in the base body half is threaded to provide the only threaded engagement with the bolt to provide a strong clamping connection without the use of a metal nut or metal plate to distribute stress. The bolt hole extends through the chimney where it is unthreaded and oversized to prevent the transmission of stress between the bolt and the chimney.

15 Claims, 1 Drawing Sheet

INSULATION PIERCING ELECTRICAL CLAMP CONNECTOR

INSULATION PIERCING ELECTRICAL CLAMP CONNECTOR

The present invention relates to electrical clamp connectors and more particularly to electrical clamp connectors of the insulation piercing type which are used to form insulated connections between electrical conductors.

BACKGROUND OF THE INVENTION

Electrical connectors of the type to which the present invention relates are shown in U.S. Pat. Nos. 4,684,196 and 4,427,253 and in German Patent No. DT 29030960. The purpose of these connectors is to form an electrical and mechanical joint between two conductors which are often of differing sizes, and which are formed of either solid wire or, more often, stranded wire bundles. The conductors are usually also covered with an insulated sheath. Quite commonly the connection to be made between the two conductors by such clamps is made by way of a tap connection, that is, by connecting the supply end of one conductor to a point along the length of another conductor which is often of larger diameter. In some applications, the connections are made when the conductors are live.

The electrical connection of these connectors is provided by one or more bridging members of electrically conductive material usually having insulation piercing teeth formed at each end of the bridging member which are able to pierce any insulation covering the conductors to form an electrical contact with the conductive wire strands. The teeth enable the formation of an electrical connection between the insulated conductors without the need to remove the insulation. The electrical connecting bridging members of the clamp connector are usually encased in and surrounded by an insulating body formed of molded insulating material The insulating body is typically formed of a pair of mating body halves which are bolted together by a bolt which passes through the insulated halves to compress them together. The assembled halves clamp the conductors therebetween driving the insulation piercing teeth into the conductors to form the electrical connection as well as a mechanical connection as the bolt is tightened.

In the design and manufacture of connectors of this type, it has been desirable to maintain an insulated barrier to protect persons installing the conductors and others working in the vicinity of these connectors and the energized conductive elements. The bridging members of these connectors are necessarily fabricated of conductive material while the remaining portion of the clamp is predominately of insulating material. It does, however, remain necessary to join the two body halves together with a steel or other strong metallic bolt in order to obtain sufficient clamping strength between the body halves. To transmit the clamping force from the bolt to the more fragile insulated material, a stress distributing plate, also of steel, is typically provided between the bolt head on one of the insulated body halves of the cap portion of the body through which the bolt is inserted. A threaded stress distributing nut or embedded plate is typically provided on the other body half or base portion to engage the nut and to distribute the stress at the insulated base portion.

To effectively insulate the conductors and bridging members, the insulating bodies of clamp connectors are provided with an insulating cylindrical chimney-like column which extends the bolt hole of one body half. The chimney interfits in a cavity around the bolt hole of the other half. The chimney insulates the bolt from the conductors, preventing the conductor strands from contacting the bolt while the clamp is being tightened. This is important both when uninsulated conductors are used and to prevent the insulation sheath on insulated conductors from being cut if deformed against the bolt during tightening.

The need to provide sufficient strength to affect the clamping action between the two clamping halves of the connector body has resulted in the use of the threaded metallic nut or a plate to receive the free end of the bolt to affect the clamping action. Some prior art devices have employed a metal threaded nut or plate at the external lower surface of the lower insulated body half to tighten on the lower bolt end. This arrangement has resulted in a protrusion of the bolt end from the lower portion of the clamp as is more particularly shown in U.S. Pat. No. 4,427,253 and German Patent DT 2903960. The protruding bolt end has had a tendency to snag on the surfaces of objects into which the conductor cables come into contact. Such a problem was overcome in U.S. Pat. No. 4,684,196 with the use of an embedded threaded plate in the lower clamp portion for tightening upon the bolt end.

The prior art clamps of both the protruding bolt and imbedded plate designs have relied heavily on the threaded metallic nut or plate to provide an adequately strong connection with the bolt so as to exert enough compressive force between the two portions of the clamp body to make an effective electrical and mechanical connection. The provision for threads in the insulative material has been introduced as shown in U.S. Pat. No. 4,684,196 to guide the bolt into proper alignment with the threads of an embedded plate and to provide some auxiliary clamping force as a result of the threaded engagement between the bolt and the lower body half. The threads formed in the lower body half have run continuously from the chimney portion through the body half and the embedded plate.

The distribution of the stress from the bolt to the insulative material of the lower clamp half by direct engagement with threads in the insulative material has resulted in the prior art in breakage of the insulative material of the clamp body. Such breakage has been experienced particularly to the chimney portion. The extended threads through the length of the bolt hole has been ineffective to avoid this problem. In the prior art, the use of the threaded metallic nut or embedded plate has been relied upon to tighten the bolt and provide the compressive force needed for the clamping action. The use of the plate, particularly when embedded in the insulative material, has also contributed to the cost of the fabrication of the clamps employing them.

Accordingly, there has existed in the prior art a need for a more effective and efficient structure for joining the two members of electrical clamps together.

SUMMARY OF THE INVENTION

It is a primary objective of the present invention to provide an effective and economical clamp for electrically and mechanically connecting two or more electrical conductors, and, particularly, the joining two members of a two part insulating electrical clamp connector body together. It has been a further objective of the present invention to provide a clamp which will eliminate the need for the metal clamping nut or plate and will do so in such a way as to prevent mechanical failure of the insulating material while making use of the insulative material to withstand the stress of the mechanical connection.

According to the principles of the present invention, there is provided a clamp connector for joining electrical conductors. The clamp connector of the present invention is provided with a pair of molded body halves, including a base body portion and a cap body portion, each formed of insulative material joined together by a metallic bolt. The bolt is threaded solely into threads formed in the insulated material of the molded base portion of the insulating body. No metal nut or plate, imbedded or surface mounted, is employed. In the preferred embodiment of the present invention, the body halves are each provided with a pair of longitudinal mating grooves in their respective mating clamping sides. Into the grooves the insulated or uninsulated conductors to be joined are placed. Conductive bridging members having insulation piercing teeth, are fitted into slots in the clamping surface of at least one of the mating body half portions, preferably only in the cap portion, to electrically connect together the joined conductors to form an electrical connection between them.

One of the insulating body halves, preferably the base portion, has a chimney extending upwardly between the pair of conductor receiving grooves to fit into an oversize bolt hole in the cap portion. A bolt is inserted through the bolt hole of the upper member and into the bolt hole of the lower half which is unthreaded and oversize, through the chimney and threaded within the large part of the base portion to which the chimney is integrally formed. In accordance with the preferred embodiment of the present invention, the threads of the lower body portion are confined to only the thick section of the base body beyond or below the chimney. The threads extend a starting point preferably spaced below the plane of the clamping side to approximately the outside surface of the base body portion. As such, the stress transmitted from the bolt to the base body portion is confined to the large part of the body half and bypasses the chimney member.

By confining the threaded portion in the section of the body base body below the chimney and shortening the threads, it is found that the connection is not weakened but is strengthened. Sufficient and greater binding force can thereby be exerted between the bolt and the lower housing half to effectively clamp the two portions together while the incidence of breakage of the chimney is reduced. As a result, the need for employing a metallic threaded nut or a metallic embedded plate is eliminated. The increased strength results in part from the shorter thread section and unthreaded oversize bolt hole through the chimney. Accordingly, it is possible to employ a body base portion formed entirely, or mostly, of one integral piece of insulation.

These and another objects and advantages of the present invention are more readily apparent from the following detailed description of the drawings in which:

DETAILED DESCRIPTION OF THE DRAWINGS

Figure 1:
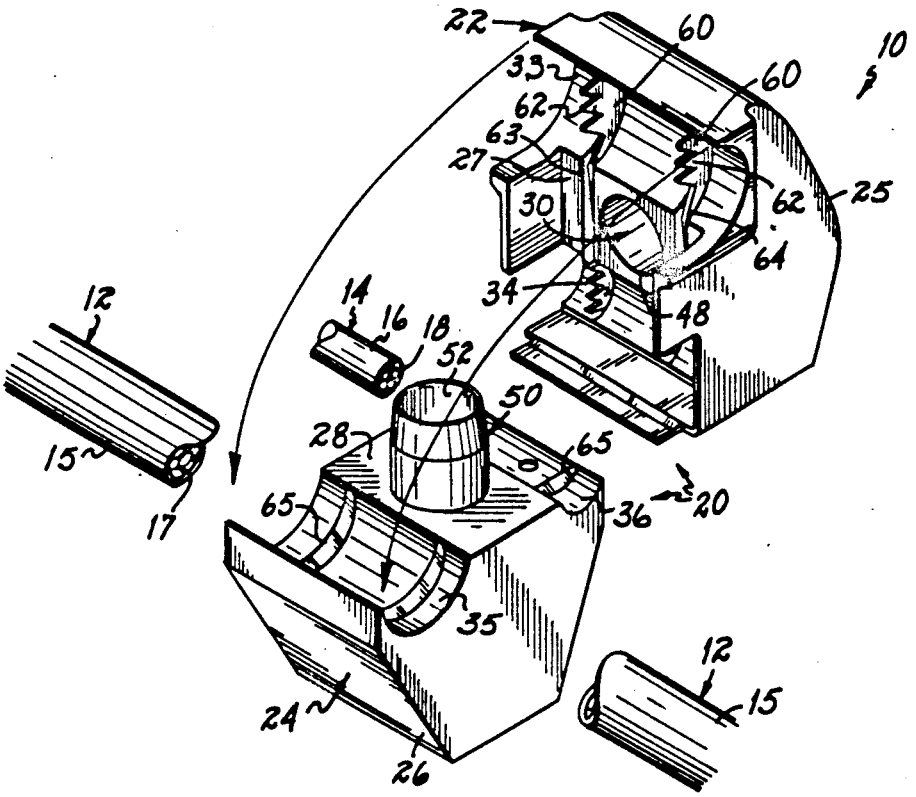
FIG. 1 is an exploded isometric view of the electrical clamp connector according to the principles of the present invention.
Figure 3:
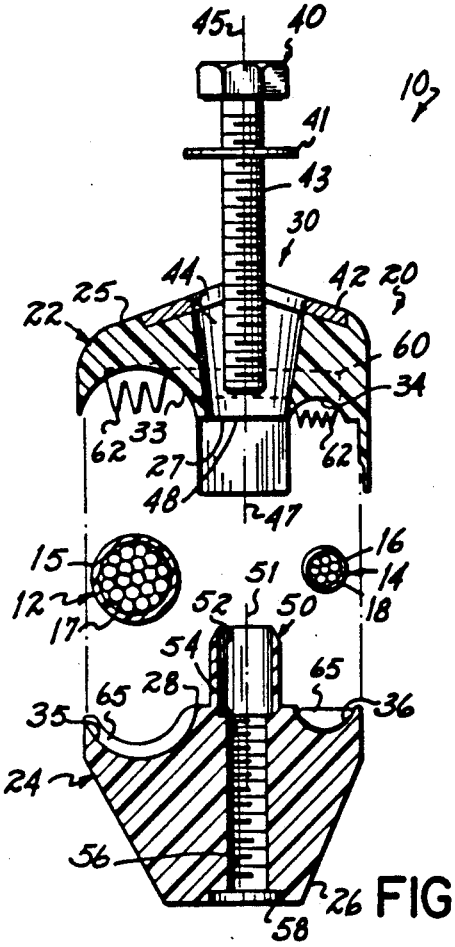
FIG. 3 is a cross sectional exploded view of an electrical clamp connector of FIG. 2.
Figure 2:
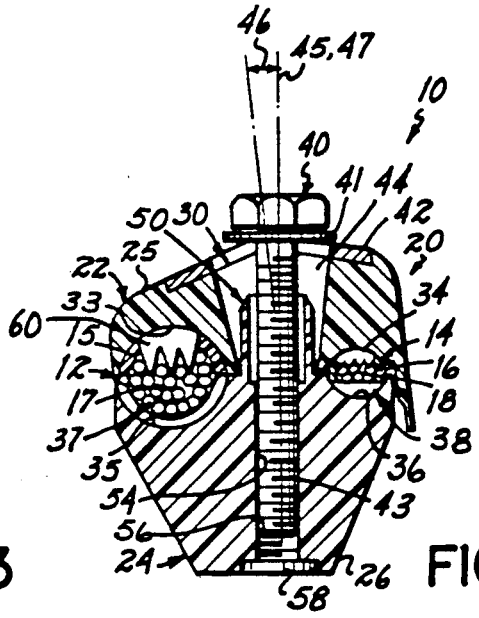
FIG. 2 is a cross-sectional view of the electrical clamp connector of FIG. 1 assembled.

An electrical clamp connector 10, according to principles of the present invention is illustrated in FIGS. 1–3. The connector 10 serves the purpose of electrically and mechanically connecting two insulated or uninsulated conductor cables 12 and 14. The cables 12 and 14 in the embodiment shown are each surrounded by a sheath of insulation 15 and 16 respectively surrounding conductors which are commonly formed of stranded conductive wire sets 17 and 18 as illustrated. In a typical application, including the application of the illustrated embodiment, the cables 12 and 14 are cables of differing sizes joined by way of a tap connection, with the cable 12 having connected to it at a point along its continuous length an end of the cable 14. The cable 14 will be frequently of smaller diameter than the cable 12 in such a connection.

The connector 10 includes an insulting housing or body 20 having two body portions or halves 22 and 24 for mechanically joining the two cables 12 and 14 together. The two body halves include an upper molded body half or cap portion 22 and a lower molded body half or base portion 24. The insulative halves 22 and 24 of the housing assembly 20 are molded of a resilent insulating plastic material, preferably of resilent glass filled nylon or such other suitable material which will provide the electrical and mechanical properties needed to insulate and clamp the conductors. The upper body portion or cap 22 has an upper convex outer surface 25 defining the top of the clamp body 20 and the lower body portion or base 24 has a lower convex outer surface 26 defining the bottom of the clamp body 20. By reference to the top or bottom of the clamp it should be appreciated that the reference is for convenience and that the orientation of the clamp is not to be considered as important to its function or the invention. The housing halves 22 and 24 are provided with respective planar clamping sides 27 and 28 thereon to clamp the conductors therebetween. The sides 27 and 28 are generally planar and are generally perpendicular to and centered around a vertical bolt hole 30 which is described in more detail below formed through each of the body portions 22 and 24. The lower clamping sides 27 of the upper body half or cap portion 22 has formed therein a pair of parallel semi-cylindrical horizontal grooves 33 and 34 for respectively receiving the cables 12 and 14. The grooves 33 and 34 are preferably of different sizes to accommodate cables of the different size ranges commonly experienced. Respectively corresponding matching grooves 35 and 36 are similarly formed in the upper clamping side 28 of the lower body half or base portion 24 for forming conductor receiving channels 37 and 38 when the clamp body 20 is assembled. The grooves 33 and 35 form channel 37 to cylindrically encase the cable 12 while the grooves 34 and 36 form channel 38 to cylindrically encase the cable 14.

The body halves 22 and 24, when the body 20 is assembled, cooperate to mechanically clamp and hold together and physically connect the cables 12 and 14. The clamping force which compresses the body halves 22 and 24 together is provided in part by a steel bolt 40 as seen in FIGS. 2 and 3.

Referring to FIGS. 2 and 3, the electrical clamp connector 10 is shown with insulated housing 20, with the cap body portion or top molded insulated half 22, and the base body portion or bottom molded insulated half 24 assembled, clamping the electrical conductors 12 and 14 together in channels 37 and 38 respectively formed between body halves 22, 24. FIG. 2 shows the connector 10 assembled and clamping cables 12 and 14 of different sizes while FIG. 3 is an exploded version of FIG. 3. As the figures show, the channels 37, 38 are respectively defined by groove pairs 33, 35 and 34, 36. The body halves 22 and 24, when assembled, are held tightly together by the bolt 40. The bolt 40 extends through a washer 41 and a stress distribution plate 42. The washer 41 and plate 42 are both made of steel.

In the embodiment shown, the connector is configured and adapted to connect a larger continuous run or conductor 12, of from sizes AWG6 through 4/0, to a smaller conductor 14 of from sizes AWG14 through AWG6. With the conductors of this size shown, the bolt 40 is a standard one-fourth inch diameter bolt with a pitch of 20 threads per inch, having threads 43 along its length.

Referring to FIGS. 2 and 3, the top housing at 22 has extending therethrough an upper oversize oblong tapered bolt receiving recess 44 which surrounds and includes part of the bolt hole 30. The bolt 40, when the clamp 10 is assembled, extends vertically through the bolt hole 30 of the molded housing 20 and lies generally on the axis 45 of the bolt 40. The recess 44 forms part of the bolt hole 30 through the upper half 22. The recess 44 is, however, oversized and oblong so as to permit a swing through an angle of from 10° to 15° as illustrated by the arrow 46 in FIG. 2 between the center line 47 of the recess 44 and the axis 45 of the bolt 40. This angle and the axes 45 and 47 lie in a plane generally perpendicular to the channels 37 and 38. This oversizing of the recess 44 allows for misalignment of the axes 45 and 47 so as to accommodate conductors 12 and 14 of varying combinations of sizes which will change the angle 46 between the housing halves 22 and 24 when the housing 20 is assembled. The recess 44, while forming an oblong opening 44 at the upper surface 25 of the cap 22, the bolt hole 30 is tapered to form an oversized circular opening 48 at the lower end of the hole 40.

Integrally formed of the base 24 and extending upwardly from its upper clamping side 28 of the base 24 is a cylindrical chimney 50. The chimney 50 is vertically aligned with its axis 51 coextensive with the axis 45 of the bolt 40 which is assembled in the bolt hole 30 when the clamp 10 is assembled. The chimney 50 is hollow and has a smooth cylindrical oversize bore 52 which forms an extension of the bolt hole 30 in the lower body half 24. The chimney 50 has an outer cylindrical surface 53 of diameter less than that of the hole 48 of the recess 44 so as that the chimney 50 fits within the cap 22 when it is assembled onto the base 24. The height of the chimney 50 is at least equal to the height of the channels 37 and 38 thus maintaining separation of the bolt 40 from the cables 12 and 14.

The lower body 24 has a lower threaded bolt hole section 54 extending therethrough to form the extension of the bolt hole 30 through the body base 24. The hole section 54 is centered on the axis 51 of the chimney 50, and extends through the body base 24 to the bottom outer surface 26 of the body half 24. Sealing the hole extension 54 at the bottom surface 26 of the body 24 is a cap 58 of insulating material connected to the body base 24 to seal the hole 54 at the outer surface 26. The bore section 54 contains a threaded section 56 which extends through the hole section 54 from a starting point preferably spaced below the upper clamping side 28 to near the bottom surface 26 of the body half 24.

The connector is further provided with conductive bridging members or plates 60 which have at each end, insulation piercing teeth 62. When the connector 10 is assembled to clamp cables in the channels 37 and 38, the teeth 62 pierce the insulation 15 and 16 of cables 12 and 14 to electrically connect the conductive strands 17 and 18 of the respective cables 12 and 14 together.

The bridging members 60 are carried, according to the preferred embodiment of the invention, only in the upper body half 22 where they are fitted into horizontal slots 63 and 64 in the lower clamping side 27 of the cap or upper body half 22. The slots 63 and 64 run perpendicular to the grooves 33 and 34, where the teeth 62 at each end of the bridging members 60 face downwardly and contact the cable conductors 12 and 14.

In the preferred embodiment, no bridging members are provided in the base portion 24 of the body 20. Instead, in the lower half 24, facing upwardly in line with the bridging members 60 are semicircular ridges 65 around the inside of the grooves 35 and 36 in the body half 24. These ridges are V-shaped in cross-section and form a sharp contacting ridge which compresses the cable insulation 15 and 16. Clamping force is further concentrated by these ridges 65 against the teeth 62 so that the teeth 62 will better penetrate the insulation upon clamping. The ridges 65 also bite against the insulation to cooperate with the teeth 62 to more tightly clamp the conductor cables 12 and 14, thus holding the cables in the connector 10 and thus restraining the conductors 12 and 14 from longitudinal slippage from the channels 37 and 38 respectively when the clamp 10 can is assembled.

Many additional details not herein expressly described are described in commonly assigned U.S. Pat. Nos. 4,427,253 and 4,684,196, which are hereby expressly incorporated herein by reference.

With the clamp connector of the present invention, stress in the lower base portion is borne entirely by this threaded portion and none of the stress is borne by the upstanding chimney 50 which has no threads to receive clamping stress from the bolt and is oversize to prevent shear forces from resulting from other contact between the bolt and the chimney. Accordingly, the stress will be confined to that portion of the lower housing half or base 24 which is strong enough to adequately support the stress developed. As such, it has been found that sufficient force may be developed in the lower section of the body 24 to completely secure the two portions of the clamp body 20 together in such a way as to permit the tension between the bolt 40 and the lower housing 24 to be borne only by threaded section 56 the insulative material of the lower body 24. Thus, the embedded plate of U.S. Pat. No. 4,684,196 and the external threaded compression plate or nut shown in U.S. Pat. No. 4,427,253 may be eliminated.

Having described the invention what is claimed:

1. An electrical clamp connector comprising:

a body cap portion being formed of a single piece of molded insulating material and having a cap clamping side, a cap outer surface, and an oblong oversize bolt hole extending therethrough from the outer surface of said body cap portion to the clamping surface of said body cap portion;

a body base portion formed of a single piece of molded insulating material and having a base clamping side constituted by a planar surface, a base outer surface, a chimney on and projecting away from the planar surface clamping side of said body base portion, opposite the base outer surface thereof, and having a remote end, and said body base portion having a length equal to the distance from said base outer surface to said remote end of said chimney, a bolt hole having a length approximately equal to the length of said body base portion and extending through said body base portion from the remote end of the chimney approximately to the outer surface of said body base portion, the bolt hole through said body base portion including an oversize unthreaded bore section and a threaded bore section, said unthreaded bore section extending through the chimney from the remote end thereof and having a length at least equal to the distance from said remote end to said base clamping side, and said threaded bore section having a length not greater than the distance from said bore clamping side to said base outer surface and having threads, formed solely in the insulating material of said body base portion, beginning and ending between the base clamping side and outer surface of said body base portion, whereby forces imparted to the threaded base portion are not directly imparted to the chimney;

said body cap portion and said body base portion being positionable, when said clamp is assembled, so that the clamping sides approximately parallel to and face each other with the bolt holes of each portion in approximate axial alignment and with the remote end of the chimney lying within the oblong oversize bolt hole of said cap portion;

a bolt having a shank with a bolt head at one end thereof and a threaded portion at the other end thereof, said bolt being positionable, when said clamp is assembled, so that the shank extends into said bolt holes with the bolt head pressing against said cap body portion at the outer surface thereof and with the threaded end thereof in threaded engagement solely with the threads of the threaded bore section of said base body portion;

at least two conductor receiving channels being formed between the clamping sides of said body portions when said clamp is assembled so as to receive a conductor therein and to mechanically secure and clamp to each said conductor when said clamp is tightened by said bolt upon assembly; and at least one bridging member of electrically conductive material mounted on at least one of said clamping sides and communicating with said channels so as to engage and electrically connect the conductors clamped therein.

2. The connector of claim 1 wherein said bridging member is formed of a conductive metallic strip and said strip is securely fitted into a slot in the clamping side of the body portion on which the member is mounted.

3. The connector of claim 1 wherein the clamping sides each have at least two pair of matching grooves formed therein, one of the grooves of each pair being formed in each of the clamping sides and positioned such that the grooves of each pair define a different one of said channels when said clamp is assembled.

4. The connector of claim 1 wherein said base body portion has integrally formed thereon an upstanding rib in said channels in opposed relationship with the bridging member.

5. The connector of claim 1 wherein said bridging member has insulation piercing teeth at each end thereof arranged to pierce the insulation of insulation sheathed conductors clamped in the channels.

6. The connector of claim 1 said bridging members include at least two bridging members in one of the clamping sides spaced to maximize the number of strands of the conductor contacted by the teeth of the bridging members.

7. The connector of claim 1 wherein said channels are parallel to each other.

8. The connector of claim 1 wherein the chimney is tubular in shape.

9. The connector of claim 1 wherein the oversize unthreaded bore section extends from said chimney beyond the body clamping side into the bolt hole within said body base portion.

10. The connector of claim 1 wherein the threads of said threaded bore are formed only in the insulating material of which said base body portion is formed and said bolt is engaged, when said clamp is assembled, with said base body portion only by the threads of said threaded bore.

11. The connector of claim 10 wherein all of said bridging members are attached to said cap body portion of said base.

12. The connector of claim 1 wherein said channels include a pair of parallel channels spaced from each other on opposite sides of the bolt holes.

13. The connector of claim 12 wherein said channels are dimensioned to accommodate conductors of different sizes, and wherein the oblong bolt hole in said cap body portion is elongated in a plane substantially perpendicular to the said channels so as to allow said cap body portion to form an angle with said bolt to accommodate conductors of differing sizes.

14. The connector of claim 12 wherein said channels are dimensioned to accommodate conductors of different sizes.

15. The connector of claim 12 wherein the oblong bolt hole in said cap body portion is elongated in a plane substantially perpendicular to the said channels so as to allow said cap body portion to form an angle with said bolt to accommodate conductors of differing sizes.

* * * * *